US008684711B2

(12) United States Patent
Stover et al.

(10) Patent No.: US 8,684,711 B2
(45) **Date of Patent: *Apr. 1, 2014**

(54) POWDER METAL SCROLL HUB JOINT

(75) Inventors: R. Christopher Stover, Versailles, OH (US); Gary J. Diller, Coldwater, OH (US); Marc J. Scancarello, Troy, OH (US); Jean-Luc M. Caillat, Dayton, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 194 days.

This patent is subject to a terminal disclaimer.

(21) Appl. No.: 13/117,848

(22) Filed: May 27, 2011

(65) Prior Publication Data

US 2011/0229360 A1 Sep. 22, 2011

Related U.S. Application Data

(62) Division of application No. 11/698,981, filed on Jan. 26, 2007, now Pat. No. 7,963,752.

(51) Int. Cl.
*F01C 1/02* (2006.01)
*F03C 2/00* (2006.01)

(52) U.S. Cl.
USPC ..... 418/55.1; 418/55.2; 418/178; 418/179

(58) Field of Classification Search
USPC ..... 418/1, 55.1–55.6, 57, 150, 178, 179
See application file for complete search history.

(56) References Cited

U.S. PATENT DOCUMENTS

| | | | |
|---|---|---|---|
| 3,600,114 | A | 8/1971 | Dvorak et al. |
| 3,889,349 | A | 6/1975 | Kaufman |
| 3,935,340 | A | 1/1976 | Yamaguchi et al. |
| 4,029,476 | A | 6/1977 | Knopp |
| 4,197,118 | A | 4/1980 | Wiech, Jr. |
| 4,550,480 | A | 11/1985 | Tanikawa et al. |
| 4,838,936 | A | 6/1989 | Akechi |
| 4,877,382 | A | 10/1989 | Caillat et al. |
| 4,944,663 | A | 7/1990 | Iizuka et al. |
| 4,958,993 | A | 9/1990 | Fujio |
| 5,044,904 | A | 9/1991 | Richardson, Jr. |

(Continued)

FOREIGN PATENT DOCUMENTS

| | | |
|---|---|---|
| AU | 2002325600 | 8/2003 |
| AU | 2008202166 | 5/2011 |

(Continued)

OTHER PUBLICATIONS

"Powder Metallurgy Handbook," pp. 134-138, (Jul. 1994), Chinese language document cited in Taiwanese Office Action issued Oct. 21, 2003 in Taiwanese Patent Application No. TW91117214.

(Continued)

*Primary Examiner* — Theresa Trieu
(74) *Attorney, Agent, or Firm* — Harness, Dickey & Pierce, P.L.C.

(57) ABSTRACT

A scroll component including a spiral scroll wrap, a baseplate having a first major surface coupled to the scroll wrap and a second opposing major surface comprising a protruding pilot extending a distance from the baseplate, and a hub fastened to the baseplate adjacent to the protruding pilot. A method of forming a scroll compressor element is also provided.

18 Claims, 7 Drawing Sheets

(56) References Cited

U.S. PATENT DOCUMENTS

| | | | | |
|---|---|---|---|---|
| 5,051,079 | A | 9/1991 | Richardson, Jr. | |
| 5,102,316 | A | 4/1992 | Caillat et al. | |
| 5,156,539 | A | 10/1992 | Anderson et al. | |
| 5,278,250 | A | 1/1994 | Ohtani et al. | |
| 5,320,506 | A | 6/1994 | Fogt | |
| 5,392,512 | A | 2/1995 | Fann et al. | |
| 5,478,220 | A | 12/1995 | Kamitsuma et al. | |
| RE35,216 | E | 4/1996 | Anderson et al. | |
| 5,511,959 | A | 4/1996 | Tojo et al. | |
| 5,534,220 | A | 7/1996 | Purnell et al. | |
| 5,580,401 | A | 12/1996 | Williamson | |
| 5,594,186 | A | 1/1997 | Krause et al. | |
| 5,759,298 | A | 6/1998 | Williamson | |
| 6,033,788 | A | 3/2000 | Cawley | |
| 6,045,601 | A | 4/2000 | Tan | |
| 6,051,184 | A | 4/2000 | Kankawa | |
| 6,079,962 | A | 6/2000 | Seibel et al. | |
| 6,106,252 | A | 8/2000 | Yamanaka et al. | |
| 6,129,530 | A | 10/2000 | Shaffer | |
| 6,139,294 | A | 10/2000 | Haller | |
| 6,139,295 | A | 10/2000 | Utter et al. | |
| 6,143,241 | A | 11/2000 | Hajaligol et al. | |
| 6,146,118 | A | 11/2000 | Haller et al. | |
| 6,171,084 | B1 | 1/2001 | Wallis et al. | |
| 6,176,094 | B1 | 1/2001 | Ohta et al. | |
| 6,196,814 | B1 | 3/2001 | Cooksey et al. | |
| 6,299,424 | B1 | 10/2001 | Futagami et al. | |
| 6,302,665 | B1 | 10/2001 | Esumi et al. | |
| 6,332,904 | B1 | 12/2001 | Fujiki et al. | |
| 6,358,298 | B1 | 3/2002 | Gagné et al. | |
| 6,572,352 | B2 | 6/2003 | Reinhart | |
| 6,705,848 | B2 * | 3/2004 | Scancarello | 418/55.2 |
| 6,766,817 | B2 | 7/2004 | da Silva | |
| 7,086,151 | B2 | 8/2006 | Scancarello | |
| 7,285,255 | B2 | 10/2007 | Kadlec et al. | |
| 7,377,904 | B2 | 5/2008 | Conway et al. | |
| 7,819,822 | B2 | 10/2010 | Calasso et al. | |
| 7,845,918 | B2 | 12/2010 | Scancarello | |
| 7,963,752 | B2 | 6/2011 | Stover et al. | |
| 2002/0025269 | A1 | 2/2002 | Esumi et al. | |
| 2003/0138339 | A1 | 7/2003 | Scancarello | |
| 2006/0093498 | A1 | 5/2006 | Kim | |
| 2006/0180640 | A1 | 8/2006 | Ariga et al. | |
| 2007/0067990 | A9 | 3/2007 | Scancarello | |
| 2008/0075622 | A1 | 3/2008 | Sakata et al. | |
| 2008/0181801 | A1 | 7/2008 | Stover et al. | |
| 2010/0229386 | A1 | 9/2010 | Scancarello et al. | |
| 2011/0052410 | A1 | 3/2011 | Scancarello | |

FOREIGN PATENT DOCUMENTS

| | | | | |
|---|---|---|---|---|
| CN | 1270661 | | 10/2000 | |
| CN | 1275456 | | 12/2000 | |
| CN | ZL02141404.1 | | 7/2008 | |
| CN | 101275567 | | 10/2008 | |
| CN | 101548107 | | 9/2009 | |
| CN | 102348898 | | 2/2012 | |
| EP | 0053301 | | 6/1982 | |
| EP | 0296552 | | 5/1993 | |
| EP | 0561343 | | 1/1997 | |
| EP | 1331395 | | 7/2003 | |
| EP | 1500818 | | 1/2005 | |
| EP | 2111508 | A | 10/2009 | |
| EP | 2282060 | | 2/2011 | |
| JP | 49-78733 | | 7/1974 | |
| JP | 57-135291 | | 8/1982 | |
| JP | 58-126492 | | 7/1983 | |
| JP | 58-210392 | | 12/1983 | |
| JP | 59-192881 | | 11/1984 | |
| JP | 61-226584 | | 10/1986 | |
| JP | 61-226589 | | 10/1986 | |
| JP | 62-003188 | | 1/1987 | |
| JP | 02-133549 | | 5/1990 | |
| JP | 02-151341 | | 6/1990 | |
| JP | 02-173378 | | 7/1990 | |
| JP | 03-294682 | | 12/1991 | |
| JP | 05-51707 | | 3/1993 | |
| JP | 05-051708 | | 3/1993 | |
| JP | 05-161947 | | 6/1993 | |
| JP | 06-128666 | | 5/1994 | |
| JP | 06-507928 | | 9/1994 | |
| JP | 07-090323 | | 4/1995 | |
| JP | 07-090324 | | 4/1995 | |
| JP | 07-090510 | | 4/1995 | |
| JP | 07-090511 | | 4/1995 | |
| JP | 07-090512 | | 4/1995 | |
| JP | 07-180681 | | 7/1995 | |
| JP | 07-188829 | | 7/1995 | |
| JP | 07-197213 | | 8/1995 | |
| JP | 07-299532 | | 11/1995 | |
| JP | 09-032747 | | 2/1997 | |
| JP | 09-073847 | | 3/1997 | |
| JP | 09-324771 | | 12/1997 | |
| JP | 10-272559 | | 10/1998 | |
| JP | 11-279676 | | 10/1999 | |
| JP | 11-336674 | | 12/1999 | |
| JP | 2000-271757 | | 10/2000 | |
| JP | 2000-294665 | | 10/2000 | |
| JP | 2001-73002 | | 3/2001 | |
| JP | 2001-81501 | | 3/2001 | |
| JP | 2001-81522 | | 3/2001 | |
| JP | 2001-115958 | | 4/2001 | |
| JP | 2001-131677 | | 5/2001 | |
| JP | 2001-234305 | | 8/2001 | |
| JP | 2001-276967 | | 10/2001 | |
| JP | 2003214365 | | 7/2003 | |
| JP | 2007-090323 | | 4/2007 | |
| KR | 1999-0060809 | A * | 7/1999 | F04C 18/02 |
| KR | 2001-0063927 | * | 7/2001 | F04C 18/02 |
| KR | 10-2006-0039180 | | 5/2006 | |
| KR | 10-0886112 | | 2/2009 | |
| KR | 10-2003-0064251 | | 7/2009 | |
| KR | 10-2009-0113242 | | 10/2009 | |
| KR | 20110123803 | | 11/2011 | |
| TW | I244953 | | 12/2005 | |
| TW | I252787 | | 4/2006 | |
| WO | WO 92/20522 | | 11/1992 | |
| WO | WO 2008/091564 | | 7/2008 | |
| WO | WO 2010/105007 | | 9/2010 | |

OTHER PUBLICATIONS

"Materials Standards for PM Structural Parts—MPIF Standard 35," Metal Powder Industries Federation (Rev. 2007).

ASM International Handbook vol. 7, Powder Metal Technologies and Applications, pp. 321-325, 468-503 and 658-659 (1998).

ASM Materials Engineering Dictionary, ed. J.R. Davis & Associates, pp. 119-120, 177, 373, and 421-422 (1992).

German, Randall M., et al., "Injection Molding of Metals and Ceramics," Metal Powder Industries Foundation, pp. 315-320 (1997).

International Search Report issued on Apr. 28, 2008 for PCT International Application No. PCT/US2008/000749 (published as WO 2008/091564).

Written Opinion of the International Searching Authority issued on Apr. 28, 2008 for PCT International Application No. PCT/US2008/000749 (published as WO 2008/091564).

International Preliminary Report on Patentability issued on Jul. 28, 2009 for PCT International Application No. PCT/US2008/000749 (published as WO 2008/091564).

Notification of the First Office Action dated Feb. 23, 2011 issued by the State Intellectual Property Office of People's Republic of China in Chinese Patent Application No. 200880000988.4 (published as CN 101548107).

Second Office Action dated Mar. 12, 2012 issued by the State Intellectual Property Office of People's Republic of China in Chinese Patent Application No. 200880000988.4 (published as CN 101548107).

Third Office Action dated Jul. 4, 2012 issued by the State Intellectual Property Office of People's Republic of China in Chinese Patent Application No. 200880000988.4 (published as CN 101548107).

(56) References Cited

OTHER PUBLICATIONS

Notification on Grant of Patent Right for Invention and Notification for Patent Registration Formalities dated Jan. 22, 2013 issued by the State Intellectual Property Office of People's Republic of China in Chinese Patent Application No. 200880000988.4 (published as CN 101548107).
International Search Report and Written Opinion of the International Searching Authority issued on Oct. 26, 2010 for PCT International Application No. PCT/US10/026902 (published as WO 2010/105007).
International Preliminary Report on Patentability issued on Sep. 13, 2011 for PCT International Application No. PCT/US10/026902 (published as WO 2010/105007).
Notification of Grounds for Refusal issued on Jan. 15, 2013 by the Korean Intellectual Property Office for Korean Patent Application No. 10-2011-7023430 (published as KR 20110123803).
Examiner's First Report dated Mar. 21, 2007 issued by IP Australia in Australian Patent Application No. 2002325600 (issued as AU 2002325600).
Examiner's First Report dated Oct. 20, 2009 issued by IP Australia in Australian Patent Application No. 2008202166 (issued as AU 2008202166).
Notification of the First Office Action dated Jul. 7, 2006 issued by the Patent Office of the People's Republic of China in Chinese Patent Application No. 02141404.1 (issued as CN ZL02141404.1).
First Office Action issued by the Chinese Patent Office on Sep. 25, 2009 regarding Chinese Patent Application No. 200810099173.8 (published as CN 101275567).
Communication dated Jul. 28, 2003 enclosing the European Search Report dated Jul. 21, 2003 issued by the European Patent Office in European Patent Application No. 02255040.4 (published as EP 1331395).
Communication dated Jun. 7, 2004 issued by the European Patent Office in European Patent Application No. 02255040.4 (published as EP 1331395).
Communication dated Feb. 23, 2006 issued by the European Patent Office in European Patent Application No. 02255040.4 (published as EP 1331395).
Communication dated Jul. 7, 2008 issued by the European Patent Office in European Patent Application No. 02255040.4 (published as EP 1331395).
Communication dated Apr. 11, 2012 issued by the European Patent Office in European Patent Application No. 02255040.4 (published as EP 1331395).
Communication dated Dec. 3, 2007 enclosing the European Search Report dated Nov. 20, 2007 issued by the European Patent Office in European Patent Application No. 04024819.7 (published as EP 1500818).
Communication dated Jan. 17, 2012 issued by the European Patent Office in European Patent Application No. 04024819.7 (published as EP 1500818).
Communication dated Sep. 10, 2012 issued by the European Patent Office in European Patent Application No. 04024819.7 (published as EP 1500818).
Communication dated Apr. 2, 2013 enclosing the European Search Report dated Mar. 19, 2013 issued by the European Patent Office in European Patent Application No. 10011092.3 (published as EP 2282060).
Notice of Reasons for Rejection dated Nov. 13, 2007 issued by the Japanese Patent Office in Japanese Patent Application No. 2002299020 (published as JP 2003214365).
Preliminary Notice of Grounds for Rejection issued on May 29, 2008 by the Korean Intellectual Property Office in Korean Patent Application No. 10-2002-0053393 (published as KR 10-2003-0064251).
Decision for Patent Grant issued on Nov. 26, 2008 by the Korean Intellectual Property Office in Korean Patent Application No. 10-2008-0084992 (issued as KR 10-0886112).
First Office Action dated Oct. 21, 2003 issued by the Intellectual Property Bureau Ministry of Economic Affairs in Taiwanese Patent Application No. 91117214 (issued as TW 1244953).
Restriction Requirement mailed Dec. 10, 2012 in U.S. Appl. No. 12/940,688 (published as US 2011/0052410).
Response to Restriction Requirement mailed Dec. 10, 2012 in U.S. Appl. No. 12/940,688 (published as US 2011/0052410), as filed on Jan. 10, 2013.
Non-Final Office Action mailed Feb. 5, 2013 in U.S. Appl. No. 12/940,688 (published as US 2011/0052410).
Response to Non-Final Office Action mailed Feb. 5, 2013 in U.S. Appl. No. 12/940,688 (published as US 2011/0052410), as filed on May 6, 2013.
Restriction Requirement mailed Oct. 24, 2012 in U.S. Appl. No. 12/720,853 (published as US 2010/0229386).
Response to Restriction Requirement mailed Oct. 24, 2012 in U.S. Appl. No. 12/720,853 (published as US 2010/0229386), as filed on Nov. 21, 2012.
Non-Final Office Action mailed Jan. 7, 2013 in U.S. Appl. No. 12/720,853 (published as US 2010/0229386).
Response to Non-Final Office Action mailed Jan. 7, 2013 in U.S. Appl. No. 12/720,853 (published as US 2010/0229386), as filed on Apr. 8, 2013.
Final Office Action mailed May 30, 2013 in U.S. Appl. No. 12/720,853 (published as US 2010/0229386).
Response to Final Office Action mailed May 30, 2013 in U.S. Appl. No. 12/720,853 (published as US 2010/0229386), as filed on Aug. 29, 2013.
Advisory Action mailed on Sep. 27, 2013 in U.S. Appl. No. 12/720,853 (published as US 2010/0229386).
Notice of Appeal and Pre-Appeal Brief Request for Review as filed on Oct. 10, 2013 in U.S. Appl. No. 12/720,853 (published as US 2010/0229386).
Notice of Allowance mailed on Jun. 25, 2013 in U.S. Appl. No. 12/940,688 (published as US 2011/0052410).
Supplemental Notice of Allowance mailed on Sep. 13, 2013 in U.S. Appl. No. 12/940,688 (published as US 2011/0052410).

* cited by examiner

FIG 2
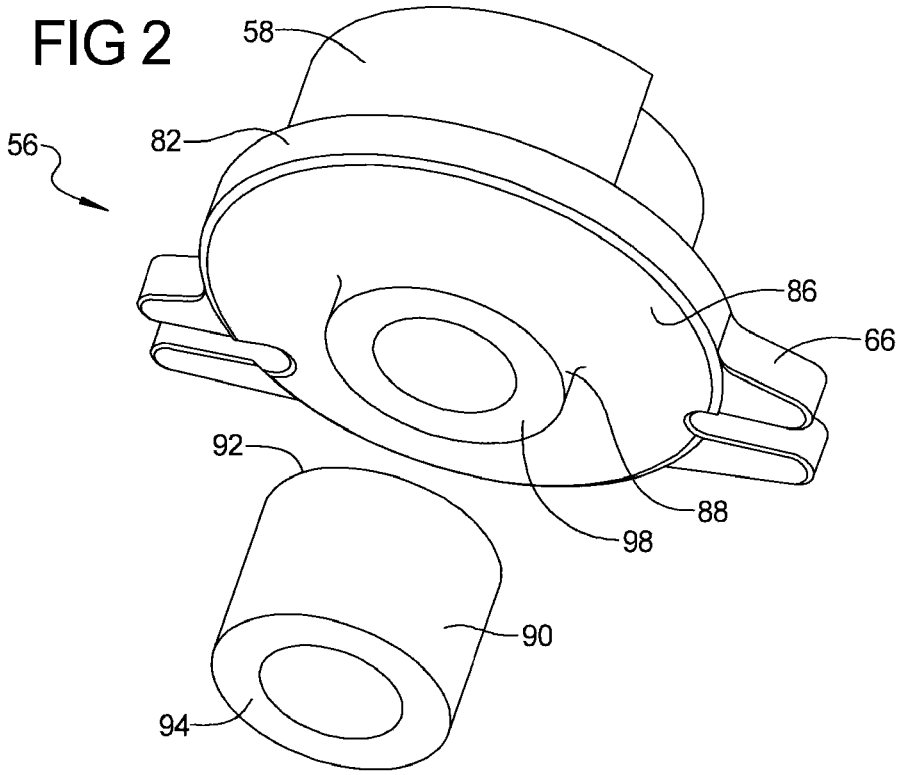
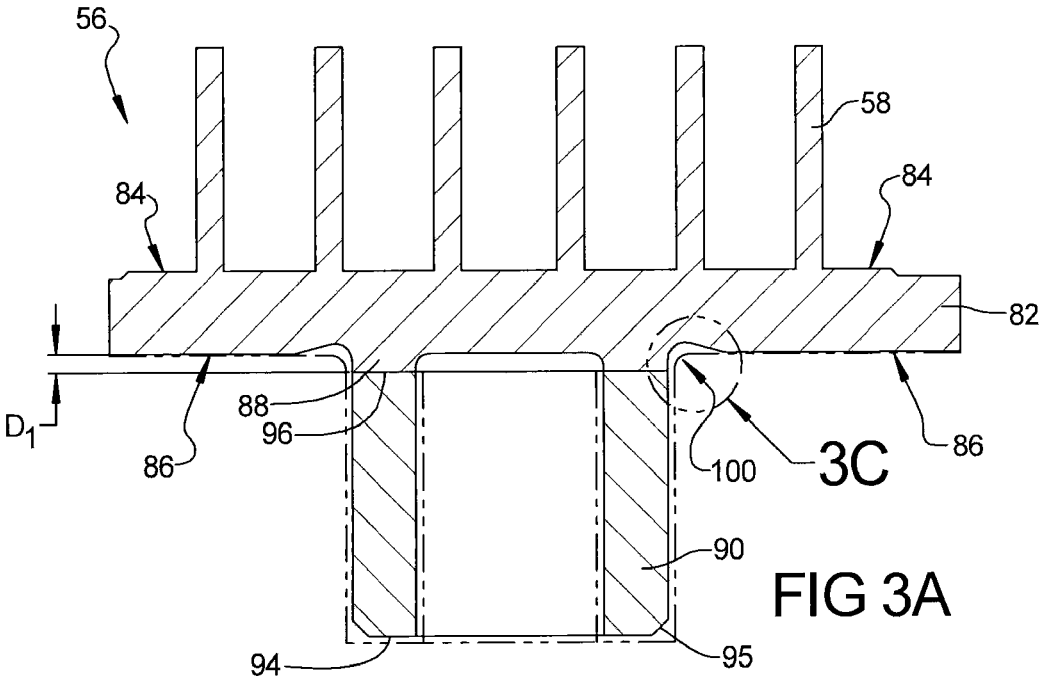
FIG 3A

FIG 3B
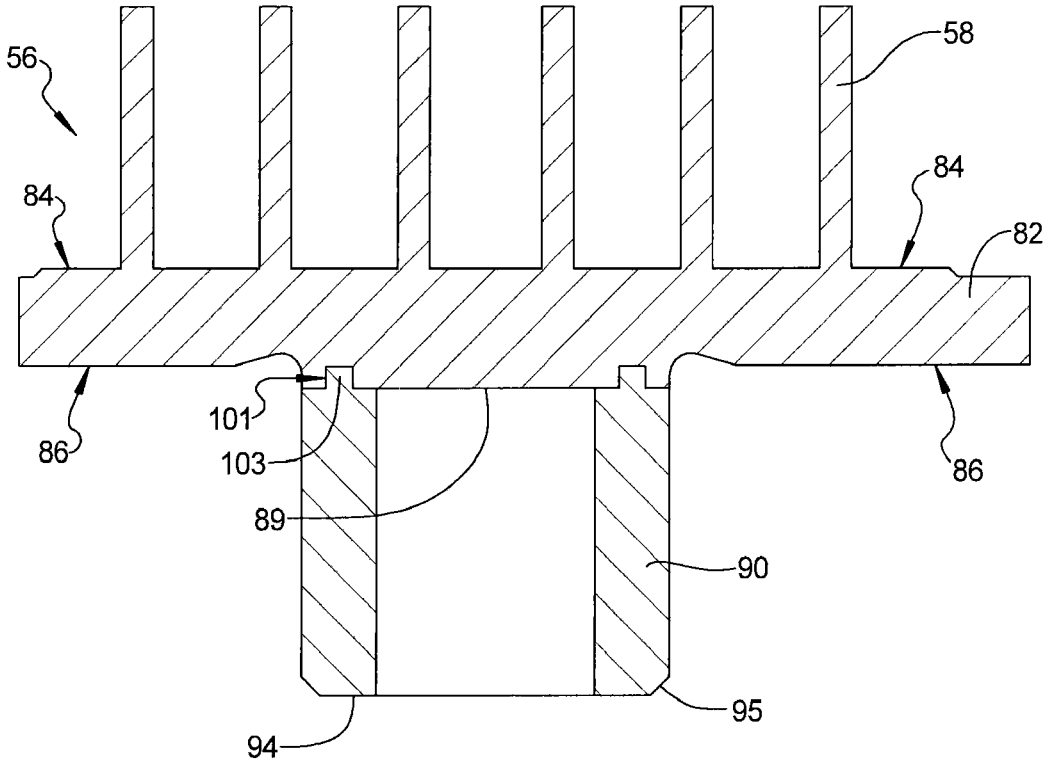
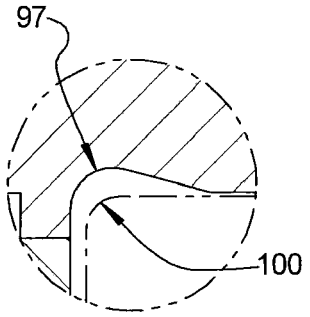
FIG 3C

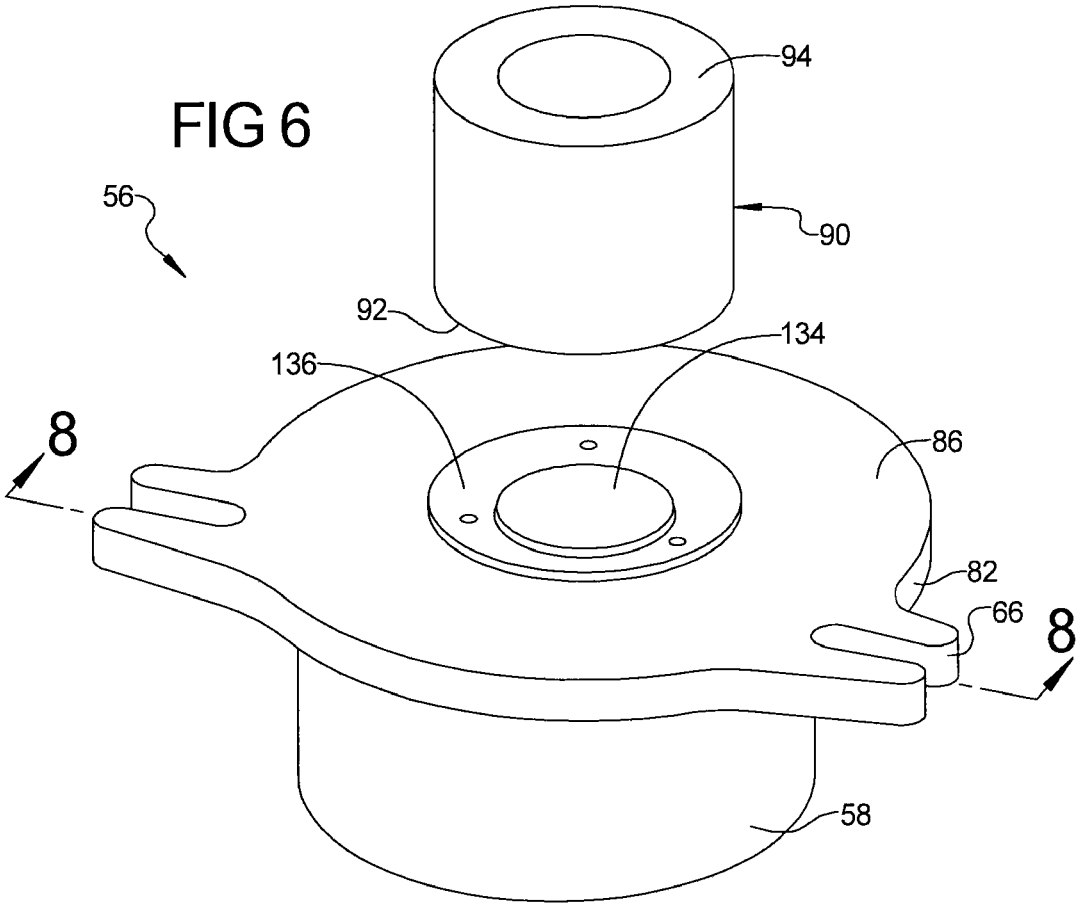
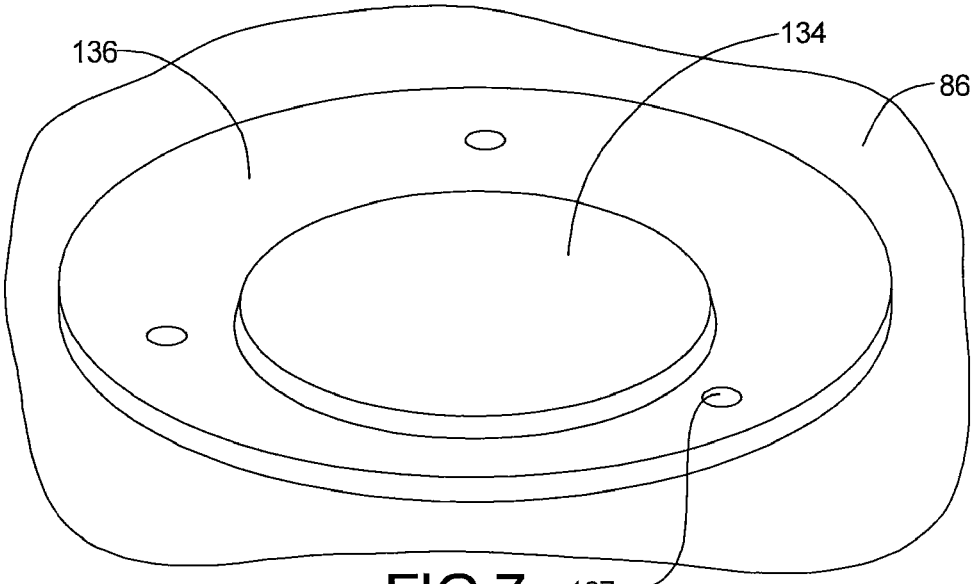
FIG 7

FIG 11
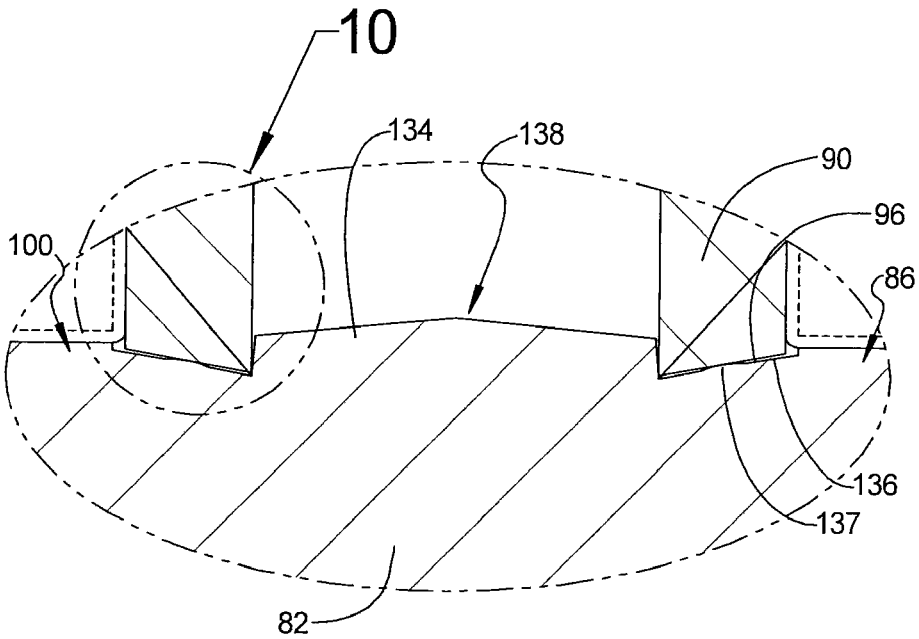
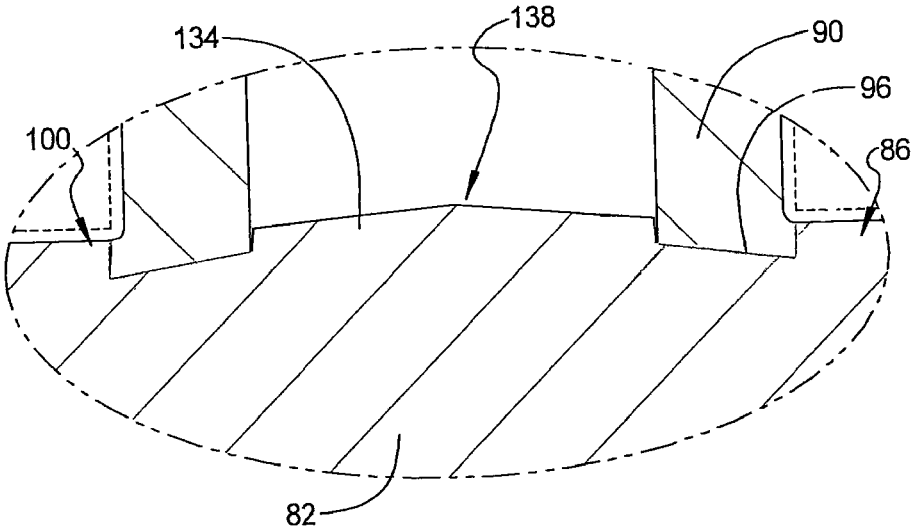
FIG 12

POWDER METAL SCROLL HUB JOINT

CROSS-REFERENCE TO RELATED APPLICATIONS

This application is a divisional of U.S. patent application Ser. No. 11/698,981 filed on Jan. 26, 2007. The entire disclosure of the above application is incorporated herein by reference.

FIELD

The present teachings relate to scroll machines, and more particularly, to a scroll compressor.

BACKGROUND

This section provides background information related to the present disclosure which is not necessarily prior art.

Scroll-type machines are commonly used as compressors in both refrigeration as well as air conditioning applications due primarily to their capability for extremely efficient operation. Unlike reciprocating technology with many moving parts, a typical scroll compressor has one scroll orbiting in a path defined by a matching non-orbiting scroll, which is attached to a compressor body. The orbiting scroll is coupled to a crankshaft in orbit, which creates a series of moving or successive gas chambers traveling between the two scrolls. On the outer portion of the scroll, a pocket draws in gas, which is compressed as the gas moves through a series of successive, increasingly smaller, moving chambers until the gas is discharged through a central port in the non-orbiting scroll.

Scroll compressors depend upon a number of seals to create and define the moving chambers. To perform properly, the scrolls must not leak, wear out or fracture. The costs associated with machining can be quite significant due to the complex shape of the scrolls themselves, the machining of grooves, and the assembly of these components.

Typical powder metal scrolls are commonly assembled by forming two individual pieces, a baseplate having a scroll wrap and a hub, and joining them together to form a scroll component. One current method of joining the two pieces together uses a brazing process. While this process is adequate for producing the scroll components, it also results in a braze joint that is situated in a potentially high stress zone, subject to localized high stresses due to the bearing loads applied to the hub. Joints that are located in high stress zones are more prone to failure as compared to joints located in lower stress zones.

SUMMARY

This section provides a general summary of the disclosure, and is not a comprehensive disclosure of its full scope or all of its features.

The present teachings are generally directed toward a scroll compressor, and more particularly to the joints of a scroll component for a scroll compressor. In one aspect, the scroll component includes a spiral scroll wrap and a baseplate having first and second opposing major surfaces. The first major surface is coupled to the scroll wrap and the second major surface includes a raised shoulder extending a distance from the baseplate. A cylindrical hub may be fastened to the raised shoulder. At least one portion of the scroll component may include a powdered metal material and the hub may be brazed to the raised shoulder.

The present teachings also provide a scroll component including a first member having a first baseplate portion and an integral spiral scroll wrap, and a second member having a second baseplate portion and an integral cylindrical hub. The first member may be joined to the second member to form a unitary scroll component.

The present teachings also provide a scroll component including a spiral scroll wrap and a baseplate. The baseplate has a first major surface coupled to the scroll wrap and a second opposing major surface including a protruding pilot extending a distance from the baseplate. A hub may be aligned with the protruding pilot and brazed to the baseplate adjacent the protruding pilot. The protruding pilot may include an annular wall.

The present teachings also provide a scroll component including a baseplate having a first major surface coupled to a scroll wrap, and a second opposing major surface having an annular tapered recess. A cylindrical hub having a tapered edge may be brazed to the tapered recess.

The present teachings also provide a scroll component including a baseplate having a first major surface coupled to a scroll wrap and a second opposing major surface having a protruding cone-shaped center pilot. A cylindrical hub may be brazed to the baseplate and surrounds the center pilot.

The present teachings also provide a method of forming a scroll compressor element. The method includes providing a baseplate having a first major surface coupled to a scroll wrap and a second opposing major surface having a protruding pilot. A cylindrical hub member is aligned with the protruding pilot. A braze material is provided adjacent at least one or both of the protruding pilot and the hub member. The hub member is then brazed to the baseplate. The protruding pilot may include a cone shape, and providing a braze material may include placing braze pellets on the protruding pilot and allowing the pellets to roll to an inside diameter of the hub member, or placing a ring of braze material onto the baseplate, the ring having a diameter sufficient to mate with the inside of the hub member, or placing a brazing paste on to the baseplate.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

The present teachings will become more fully understood from the detailed description and the accompanying drawings, wherein:

FIG. 2 is an exploded perspective view of an orbiting scroll component according to the present teachings;

FIG. 3A is a cross-sectional view of an assembled orbiting scroll component as illustrated in FIG. 2;

FIG. 3B is a cross-sectional view of an assembled orbiting scroll component according to another aspect of the present teachings;

FIG. 3C is a partial magnified view of FIG. 3A;

FIG. 6 is an exploded perspective view of an orbiting scroll member according to the present teachings;

FIG. 7 is a partial magnified view of FIG. 6;

FIG. 11 is a partial magnified view of FIG. 8 illustrating a machined area; and FIG. 12 is a partial magnified view of FIG. 8 according to another aspect of the present teachings.

Corresponding reference numerals indicate corresponding parts throughout the several views of the drawings.

DETAILED DESCRIPTION

Example embodiments will now be described more fully with reference to the accompanying drawings.

The following description is merely exemplary in nature and is in no way intended to limit the teachings, its application, or uses.

Figure 1:
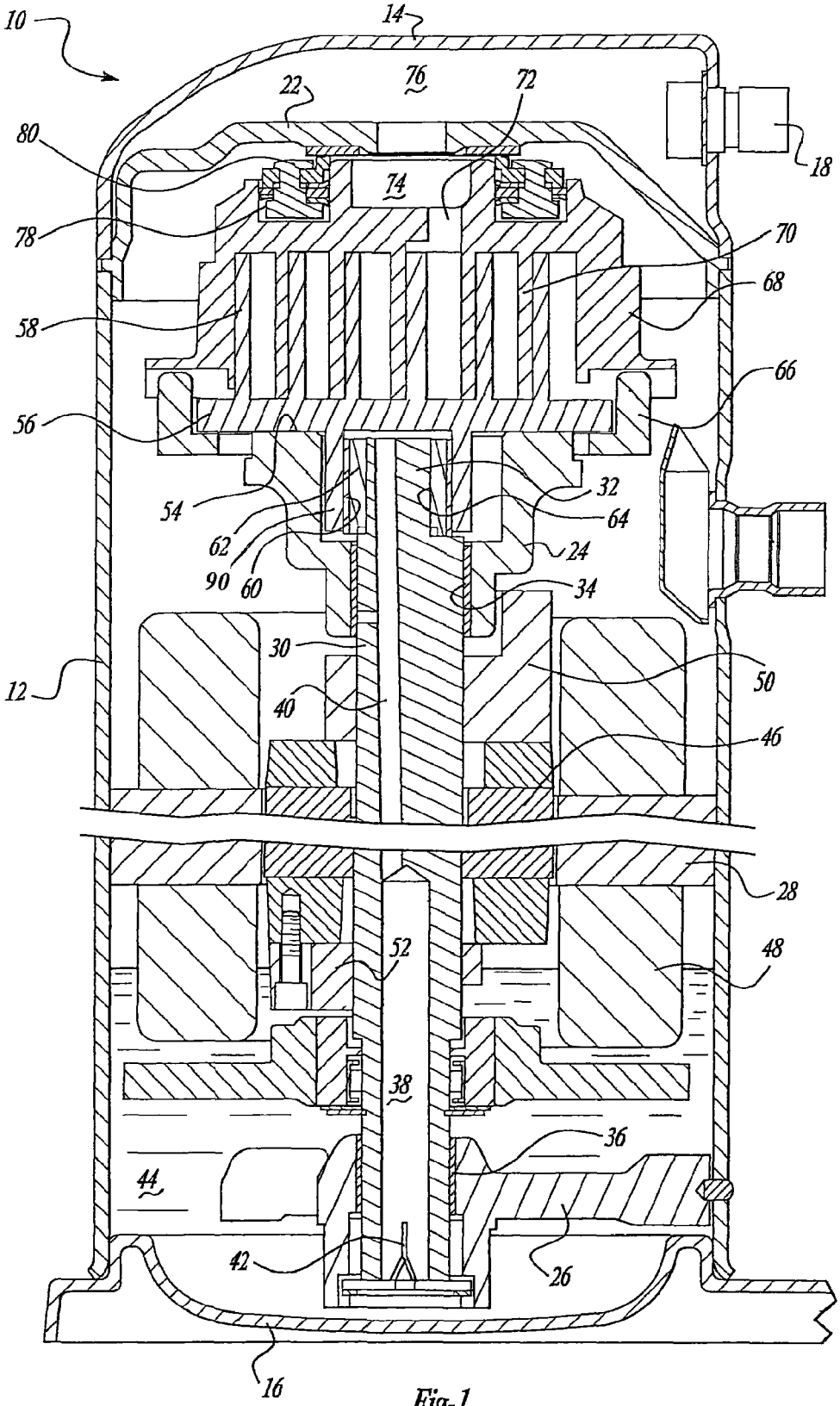
FIG. 1 is a vertical cross-sectional view through the center of a scroll type refrigeration compressor incorporating a scroll component in accordance with the present teachings.

Referring to the drawings in which like reference numerals designate like or corresponding parts throughout the several views, FIG. 1 illustrates an exemplary scroll compressor 10 that is capable of incorporating a representative scroll component in accordance the present teachings. The compressor 10 includes a generally cylindrical hermetic shell 12 having a cap 14 welded at the upper end thereof and a base 16 at the lower end optionally having a plurality of mounting feet (not shown) integrally formed therewith. The cap 14 is provided with a refrigerant discharge fitting 18 which may have the usual discharge valve therein (not shown). Other major elements affixed to the shell include a transversely extending partition 22 welded about its periphery at the same point that the cap 14 is welded to the shell 12, a main bearing housing 24 suitably secured to the shell 12, and a lower bearing housing 26 also having a plurality of radially outwardly extending legs, each of which is also suitably secured to the shell 12. A motor stator 28, which is generally polygonal in cross-section, e.g., 4 to 6 sided, with rounded corners, is press fitted into the shell 12. The flats between the rounded corners on the stator provide passageways between the stator and shell, which facilitate the return flow of lubricant from the top of the shell to the bottom.

A drive shaft or crankshaft 30 having an eccentric crank pin 32 at the upper end thereof is rotatably journaled in a bearing 34 in the main bearing housing 24. A second bearing 36 is disposed in the lower bearing housing 26. The crankshaft 30 has a relatively large diameter concentric bore 38 at the lower end which communicates with a radially outwardly inclined smaller diameter bore 40 extending upwardly therefrom to the top of the crankshaft 30. A stirrer 42 is disposed within the bore 38. The lower portion of the interior shell 12 defines an oil sump 44 filled with lubricating oil to a level slightly lower than the lower end of a rotor 46 but high enough to immerse a significant portion of the lower end turn of the windings 48. The bore 38 acts as a pump to pump lubricating fluid up the crankshaft 30 and into the passageway 40 and ultimately to all of the various portions of the compressor which require lubrication.

The crankshaft 30 is rotatively driven by an electric motor including a stator 28 and windings 48 passing therethrough. The rotor 46 is press fitted on the crankshaft 30 and has upper and lower counterweights 50 and 52, respectively.

The upper surface of the main bearing housing 24 is provided with a flat thrust bearing surface 54 on which an orbiting scroll member 56 is disposed having the usual spiral vane or wrap 58 on the upper surface thereof. A cylindrical hub 90 downwardly projects from the lower surface of orbiting scroll member 56 and has a bearing bushing 60 therein. A drive bushing 62 is rotatively disposed in the bearing bushing 60 and has an inner bore 64 in which a crank pin 32 is drivingly disposed. Crank pin 32 has a flat on one surface which drivingly engages a flat surface formed in a portion of the bore 64 to provide a radially compliant driving arrangement, such as shown in U.S. Pat. No. 4,877,382, the disclosure of which is hereby incorporated herein by reference. An Oldham coupling 66 is provided positioned between the orbiting scroll member 56 and the bearing housing 24 and is keyed to the orbiting scroll member 56 and a non-orbiting scroll member 68 to prevent rotational movement of the orbiting scroll member 56. The Oldham coupling 66 may be of the type disclosed in U.S. Pat. No. 5,320,506, the disclosure of which is hereby incorporated herein by reference.

The non-orbiting scroll member 68 includes a wrap 70 positioned in meshing engagement with the wrap 58 of the orbiting scroll member 56. The non-orbiting scroll member 68 has a centrally disposed discharge passage 72 that communicates with an upwardly open recess 74 in fluid communication with a discharge muffler chamber 76 defined by the cap 14 and the partition 22. An annular recess 78 may be formed in the non-orbiting scroll member 68 within which a seal assembly 80 is disposed. The recesses 74, 78 and the seal assembly 80 cooperate to define axial pressure biasing chambers to receive pressurized fluid compressed by the wraps 58, 70 so as to exert an axial biasing force on the non-orbiting scroll member 68 to urge the tips of the respective wraps 58, 70 into sealing engagement with the opposed end plate surfaces. The seal assembly 80 may be of the type described in greater detail in U.S. Pat. No. 5,156,539, the disclosure of which is hereby incorporated herein by reference. The non-orbiting scroll member 68 may be designed to be mounted to the bearing housing 24 in a suitable manner such as disclosed in the aforementioned U.S. Pat. No. 4,877,382 or U.S. Pat. No. 5,102,316, the disclosure of which is hereby incorporated herein by reference.

FIG. 2 illustrates an exploded perspective view of an orbiting scroll member 56 and FIG. 3A is a cross-sectional view of an assembled orbiting scroll member as illustrated in FIG. 2. As shown, the orbiting scroll member 56 may include a generally circular baseplate 82 having first and second generally planar opposing major surfaces represented by reference numbers 84 and 86, respectively. The first major surface 84 may be coupled to the spiral scroll wrap 58. The second major surface 86 may include a raised portion such as an annular raised shoulder 88 as shown in FIG. 3A, or a raised cylindrical pad 89 as shown in FIG. 3B, extending a distance generally perpendicular to the baseplate 82. The scroll wrap 58 and the baseplate 82 may be one monolithic component formed out of powdered metal using techniques known in the art, such as disclosed in U.S. Pat. No. 6,705,848, the disclosure of which is hereby incorporated herein by reference, or may include multiple components joined together such as by using brazing materials to join a scroll wrap 58 to a baseplate 82. The components may also be produced from a powder metal or wrought material.

A cylindrical hub member 90 may include first and second opposing edges 92, 94. The hub member 90 may be formed using wrought material, standard casting techniques or other forming processes, including powdered metal, and is fastened to the baseplate 82. For example, the hub member 90 may be brazed to the raised shoulder 88, or raised pad 89, at a joint 96 using typical brazing methods known to those skilled in the art. It may also be brazed using methods suitable for use with powdered metal materials. For example, the green components can be assembled and brazed together while the powder metal component is sintered. A solid hub may be fastened utilizing materials that harden during the sintering process.

With reference to FIG. 3A, the raised shoulder 88 (or cylindrical pad 89 of FIG. 3B) may extend a distance $D_1$ from the second major surface 86. This distance $D_1$ may be from about 5 to about 20 times less than the base plate 82 thickness. The hub edge 92 and raised shoulder edge 98 may be provided with complementary tapered angles configured to mate and form a tapered joint 96. The angle of the tapered surface to the base plate may be between about 0 and about 20 degrees. Phantom lines, as shown in FIG. 3A (and other figures), illustrate the form of the scroll components prior to any machining, if desired, as the parts are assembled and sintered. After assembled, the scroll 56 may be machined having a final shape as shown in FIG. 3B. A slightly recessed annular groove or recessed channel 100 may be initially formed or subsequently machined around the raised shoulder 88, or cylindrical pad 89, prior to the hub member 90 being brazed to the baseplate 82 if desired. The channel 100 may serve as a braze dam that assists in minimizing any flow of braze material onto a thrust surface of the scroll member 56. Additionally, the lower edge 94 of the hub member 90 may be machined with angled or rounded corners 95.

The use of a raised shoulder 88, or raised pad 89, may increase the overall strength of the scroll member 56 by moving the actual braze joint location 96 away from one of the highest localized stress zones, which is the mid-radius point, or thereabout, as designated by reference number 97. This area 97 typically exhibits the most applied bearing loads during use, and is now slightly removed from the hub and baseplate braze joint by the use of the raised should 88 or pad 89.

FIG. 3B illustrates the raised pad 89 feature where the centralized portion of the baseplate 82 that is joined to the hub 90 is raised completely across, to simplify the overall part structure. As previously discussed, the hub member 90 may be joined to the baseplate 82 with a brazing process. During the brazing process, it may be necessary to align and retain the hub member 90 in an intended final brazing position with respect to the baseplate 82 and to prevent and/or minimize any movement away from the intended joint 96. As shown in this embodiment, the baseplate may be provided with an integral recessed pilot, or vane 101, and the hub 90 may be provided with an external protruding pilot 103 for consistent pre-assembly placement and alignment of the of the hub 90 onto the baseplate 82, before they are brazed together. As illustrated, the protruding pilot 103 has a substantially rectangular cross-section. However, as should be understood to those skilled in the art, the pilot cross-section may also be triangular, semi-circular, etc.

Figure 4A:
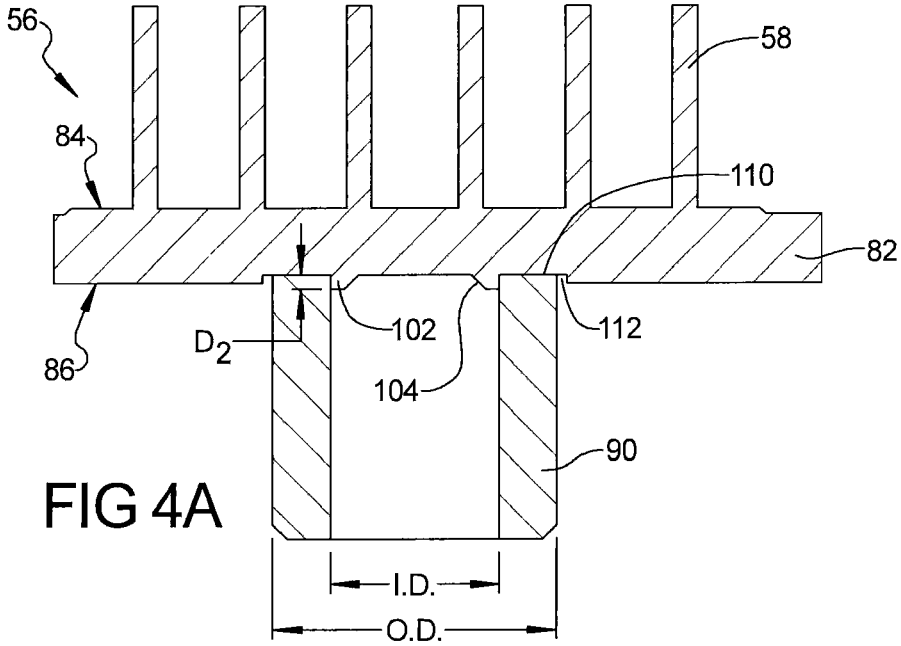
FIG. 4A is a cross-sectional view of an assembled orbiting scroll component according to another aspect of the present teachings.

FIG. 4A illustrates a cross sectional view of a scroll component 56 depicting another aspect of the present teachings. Similar to FIGS. 3A and 3B, the baseplate 82 has a first major surface 84 coupled to the scroll wrap 58 and a second opposing major surface 86 with an annular recess 110. To aid alignment, the annular recess 110 of the baseplate 82 may include a protruding pilot 102 extending a distance $D_2$ generally perpendicular to the baseplate 82. The distance $D_2$ may be about 2 to about 20 times smaller than the thickness of the baseplate. The hub member 90 may be fastened, e.g., brazed, to the baseplate 82 adjacent the protruding pilot 102.

The protruding pilot 102 may be an annular wall that assists in aligning the hub member 90 with the baseplate 82 and to minimize any shifting, misalignment, or movement between the hub 90 and the baseplate 82 during the fastening process. The annular wall may be a continuous ring-shaped protrusion, or may include a plurality of discontinuous sections (not shown) configured to serve the same purpose. The protruding pilot 102 may be formed having a generally hollow cylindrical shape, or may be formed having one or more angled or tapered sides 104 that do not allow excessive shifting or movement of the hub member 90 with respect to the baseplate 82.

The baseplate 82 may include an annular recessed area 110 circumferentially disposed around the protruding pilot 102 and configured to be joined with an edge 92 of the hub member 90. As shown, the recessed area can be sized slightly larger than the edge 92 of the hub member 90 to provide a small gap area 112 for excess brazing material as will be described in more detail below. The recessed area 110 may be tapered and the hub member may include a complementary tapered edge configured to mate with the baseplate recess 110 and form a tapered joint 96.

Figure 4B:
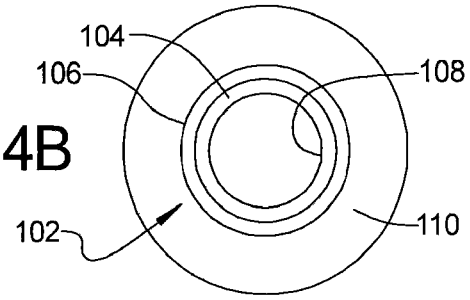
FIG. 4B is a bottom view of the assembled orbiting scroll component of FIG. 4A illustrating a protruding pilot.

As shown in FIG. 4B, which illustrates a partial bottom plan view of a center portion of the baseplate 82, the protruding pilot may be disposed on the baseplate 82 such that its outermost edge 106 is adjacent to and abuts the inner diameter (ID) of the hub member 90. In other aspects, the protruding pilot may be disposed on the baseplate 82 such that it would surround the hub member 90 and have an innermost edge 108 abutting the outer diameter (OD) of the hub member 90.

Figure 5:
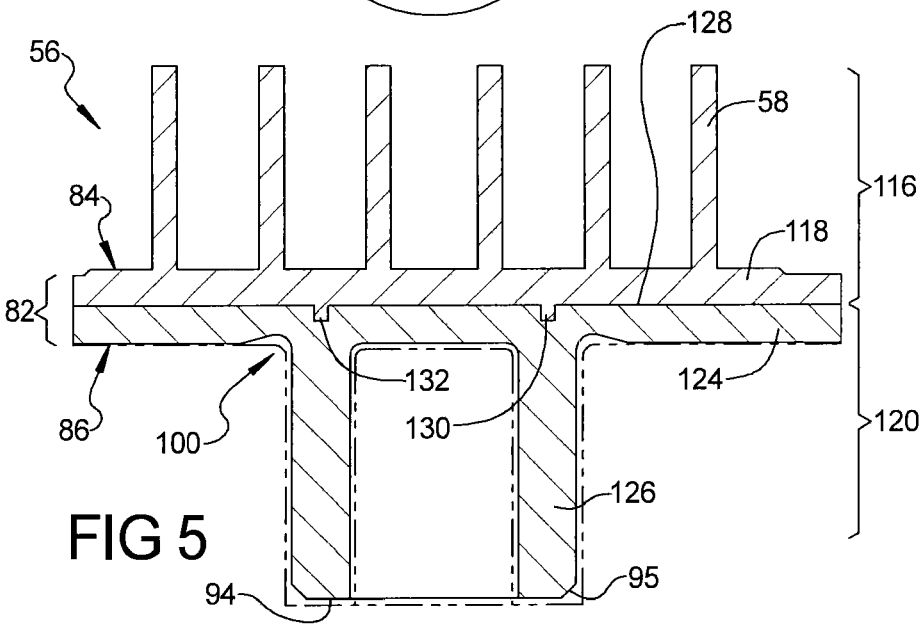
FIG. 5 is a cross-sectional view of an assembled orbiting scroll component according to another aspect of the present teachings.

FIG. 5 illustrates a cross-sectional view of a scroll component 56 including a first member 116 including a first baseplate portion 118 and an integral scroll wrap 58. A second member 120 may include a second baseplate portion 124 and an integral cylindrical hub portion 126. The first member 116 is joined to the second member 120 at a joint 128, such as by brazing the first baseplate portion to the second baseplate portion, to form a unitary scroll component 56.

As shown, the first baseplate portion 118 and the second baseplate portion 124 are of equivalent diameter and each include roughly half of the width, or thickness, of the baseplate 82. The dimensions of each portion 118, 124 are not required to be the same, however, and suitable variations are within the scope of the present teachings. At least one or both of the baseplate portions 118, 124 may include a protruding pilot 130 to assist in providing uniform and accurate alignment of the first and second members 116, 120 prior to brazing. Accordingly, at least one or both of the baseplate portions 118, 124 may also include an internal, or recessed pilot 132, configured to mate with the protruding pilot 130. Additionally, the lower edge 94 of the hub member 90 may be machined with angled or rounded corners 95.

FIG. 6 illustrates an exploded perspective view of an orbiting scroll component 56 with the baseplate 82 having a first major surface 84 coupled to a scroll wrap 58 and a second opposing major surface 86 having a protruding cone shaped center pilot 134. FIG. 7 illustrates a partial magnified perspective view of the center pilot 134 area of the baseplate 82 of FIG. 6. The baseplate surface 86 may further define an annular tapered recess 136 surrounding the center pilot 134.

The annular recess 136 may be tapered to mate with a tapered edge 92 of the hub member 90 to form a tapered joint 96.

Figure 8:
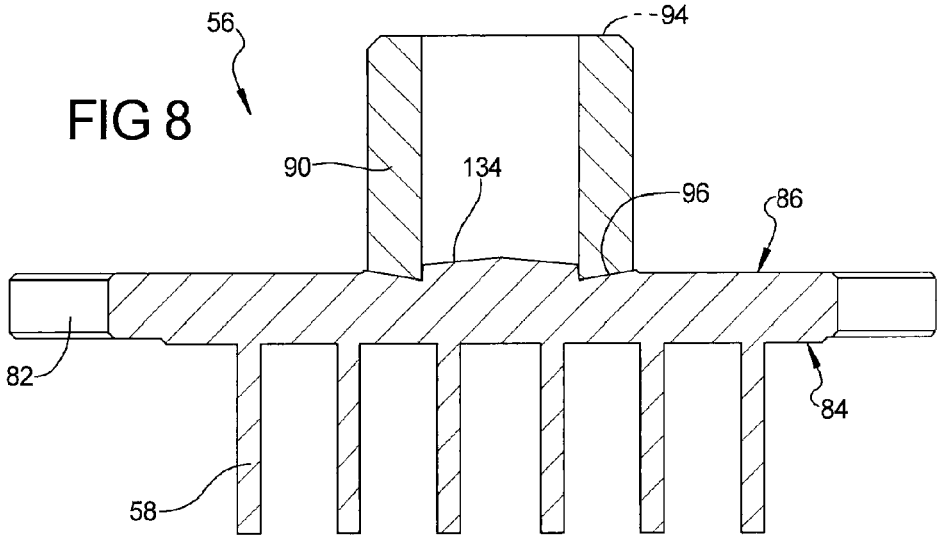
FIG. 8 is a cross-sectional view of an assembled orbiting scroll member of FIG. 6 taken along the reference line 8-8.
Figure 9:
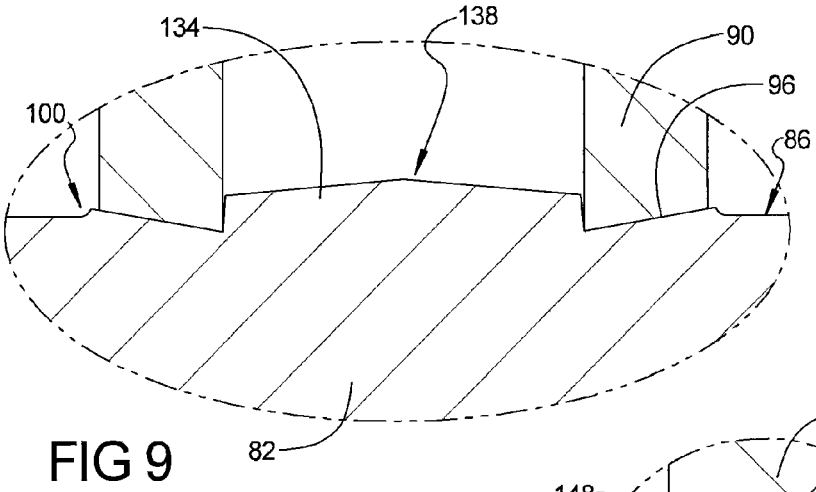
FIG. 9 is a partial magnified view of FIG. 8.
Figure 10:
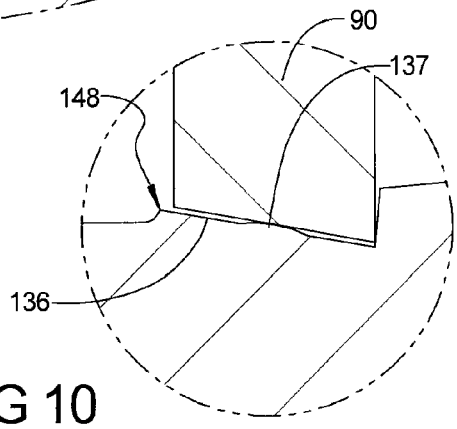
FIG. 10 is a partial magnified view of FIG. 9.

FIG. 8 illustrates a cross-sectional view of FIG. 6 taken along the reference line 8-8. FIG. 9 is a partial magnified view of FIG. 8 depicting a center point 138 of the cone shaped pilot 134. The tapered, cone shaped protruding pilot 134 assists spherical shaped braze pellets to roll to the inner diameter of the hub member 90 prior to the brazing process. The annular recess 136 of the baseplate 82 may be sized having a width slightly larger than a width of the tapered edge 92 of the hub member 90 such that there is a slight extension 148 as best shown in FIG. 10, which is a partial magnified view of FIG. 9. FIG. 11 is a variation of FIG. 9 illustrating the outer edge areas of the joint 96 after a machining process. In this regard, FIG. 11 shows an exterior coupling radius formed on the hub 90. FIG. 12 illustrates a further orientation of the joint 96 between the hub member 90 and the baseplate 82 where the angle of the joint 96 is reversed.

As best seen in FIGS. 6, 7, 10, and 11, the annular recess 136 can have a plurality of protrusion 137 radially disposed about the annular recess. In this regard, the protrusion 137 is configured to control the gap between the hub 90 and the annular recess 136. This allows for the proper flow and distribution of the braze material between the hub 90 and the annular recess 136.

A method of joining a cylindrical hub member to a baseplate of a scroll component includes providing a baseplate having a first major surface coupled to a scroll wrap and a second opposing major surface having a protruding pilot. The cylindrical hub member is aligned with the protruding pilot, and a braze material, such as a braze paste, or spherical braze pellets are provided adjacent at least one or both of the protruding pilot and the hub member. The protruding pilot may include a cone shape and providing a braze material may include placing braze pellets on the protruding pilot and allowing the pellets to roll to an inside diameter of the hub member prior to the brazing process. In other aspects, a ring of braze material is placed onto the baseplate having a diameter sufficient to mate with the inside of the hub member. The hub member is then brazed to the baseplate, and any desired machining of the scroll component can be performed.

The description is merely exemplary in nature and, thus, variations are intended to be within the scope of the teachings.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A scroll component comprising:

a spiral scroll wrap;

a baseplate having first and second opposing major surfaces, the first major surface coupled to the scroll wrap;

a centrally disposed raised portion forming at least one of a protruding pilot, an annular raised shoulder, or a raised cylindrical pad, extending from the second major surface of the baseplate, wherein the raised portion is configured to align a hub; and the hub fastened to the baseplate and in contact with at least a portion of the raised portion, wherein the raised portion extends radially from a center of the baseplate to an outermost edge that is adjacent to or within a region defined by an inside diameter of the hub extending to an outside diameter of the hub.

2. The scroll component according to claim 1, wherein the hub is brazed to the baseplate.

3. The scroll component according to claim 1, wherein the raised portion only extends to the outside diameter of the hub on the second major surface of the baseplate when the hub is fastened to the baseplate.

4. The scroll component according to claim 1, wherein at least one of the spiral scroll wrap, the baseplate, and the hub comprises either a powdered metal material or a wrought metal material.

5. The scroll component according to claim 1, wherein the baseplate and the coupled spiral scroll wrap are a monolithic component.

6. The scroll component according to claim 1, wherein the baseplate comprises a channel circumferentially disposed around the raised portion.

7. The scroll component according to claim 1, wherein a ratio of a thickness of the baseplate to a thickness of the raised portion is about 5:1 to about 20:1.

8. The scroll component according to claim 1, wherein the hub has the inside diameter and the outside diameter, and the raised portion includes a protruding pilot that comprises an annular wall, wherein the annular wall is disposed adjacent to either the outside diameter of the hub or to the inside diameter of the hub, when the hub is fastened to the baseplate.

9. The scroll component according to claim 1, wherein the raised portion is a protruding pilot having either a generally cylindrical shape or a generally conical shape.

10. A scroll compressor comprising the scroll component according to claim 1.

11. A scroll component comprising:

a spiral scroll wrap; and a baseplate having a first major surface attached to the scroll wrap and a second opposing major surface having a protruding cone-shaped center pilot configured to align a cylindrical hub, wherein the protruding cone-shaped center pilot extends to a region adjacent to an inside diameter of the cylindrical hub, wherein the hub is brazed to the baseplate and in contact with at least a portion of the protruding cone-shaped center pilot.

12. The scroll component according to claim 11, wherein the baseplate further comprises a tapered annular recess surrounding the protruding cone-shaped center pilot.

13. The scroll component according to claim 12, wherein the tapered annular recess further comprises a plurality of protrusions.

14. A scroll compressor comprising the scroll component according to claim 11.

15. A scroll component comprising:

a spiral scroll wrap;

a baseplate having first and second opposing major surfaces, the first major surface coupled to the scroll wrap;

a raised portion comprising a protruding pilot extending from the second major surface of the baseplate configured to align a hub, wherein the second major surface further comprises an annular recessed area that is disposed around the protruding pilot; and the hub fastened to the baseplate and in contact with at least a portion of the raised portion.

16. The scroll component according to claim 15, wherein the annular recessed area is tapered.

17. The scroll component according to claim 15, wherein the annular recessed area has a first depth from the opposing second major surface at a first radius, and a second depth from the opposing second major surface at a second radius, wherein the first depth is greater than the second depth.

18. The scroll component according to claim 15, wherein the annular recessed area further comprises a plurality of protrusions.

* * * * *